US006644628B1

(12) United States Patent
Triche

(10) Patent No.: US 6,644,628 B1
(45) Date of Patent: Nov. 11, 2003

(54) VEHICLE LEVELING APPARATUS

(76) Inventor: Freddie J. Triche, 98 Glenwood St., Morgan City, LA (US) 70380

( * ) Notice: Subject to any disclaimer, the term of this patent is extended or adjusted under 35 U.S.C. 154(b) by 0 days.

(21) Appl. No.: 10/431,558

(22) Filed: May 7, 2003

(51) Int. Cl.[7] ..... E02C 3/00

(52) U.S. Cl. ..... 254/88; 14/69.5; 248/188.2

(58) Field of Search ..... 254/88, 94; 152/268, 152/246, 213 R, DIG. 19; 81/15.8; 248/346.01, 351, 352, 188.2; 206/304; 238/14; 188/32; 14/69.5, 71.1

(56) References Cited

U.S. PATENT DOCUMENTS

| | | | | | |
|---|---|---|---|---|---|
| 1,452,188 | A | | 4/1923 | Christ | |
| 2,420,130 | A | * | 5/1947 | Foss | 254/88 |
| 3,326,525 | A | | 6/1967 | Kauppi | |
| 3,661,224 | A | | 5/1972 | Stenhaus | |
| 3,784,161 | A | | 1/1974 | Frese | |
| 3,863,890 | A | * | 2/1975 | Ruffing | 254/10 C |
| 4,034,961 | A | | 7/1977 | Breen | |
| 4,058,292 | A | * | 11/1977 | Goodrich et al. | 254/88 |
| 4,165,862 | A | | 8/1979 | Bennett | |
| 4,427,179 | A | | 1/1984 | Price | |
| 4,461,456 | A | | 7/1984 | Munna | |
| 4,819,910 | A | | 4/1989 | Johnston | |
| 5,239,854 | A | * | 8/1993 | Hinson | 72/457 |
| 5,328,154 | A | | 7/1994 | Blatz et al. | |
| 5,690,314 | A | * | 11/1997 | Williams | 254/88 |
| 5,894,618 | A | | 4/1999 | Jacobsen et al. | |
| 6,439,543 | B1 | | 8/2002 | Peckham | |
| 6,520,344 | B2 | | 2/2003 | Graham | |

* cited by examiner

*Primary Examiner*—Joseph J. Hail, III
*Assistant Examiner*—Daniel G. Shanley
(74) *Attorney, Agent, or Firm*—Ted M. Anthony

(57) ABSTRACT

A vehicle leveling apparatus for leveling vehicles, especially large recreational vehicles, trailers and the like. A support base having a channel formed by parallel inclined walls is disposed on an uneven parking surface. A leveling track is pivotally disposed within the channel of the support base. The leveling track can be adjusted to different height levels. The leveling track is set at a desired height and tilted toward the wheels of a vehicle. The vehicle is moved onto the leveling track, thereby raising the vehicle into a level position. An adjustable chock prevents the vehicle from traveling off the leveling track.

10 Claims, 5 Drawing Sheets

VEHICLE LEVELING APPARATUS

BACKGROUND OF THE INVENTION

1. Field of the Invention

The invention relates to a leveling apparatus for vehicles, especially large recreational vehicles, trailers and the like.

2. Description of the Prior Art

Many types of vehicles and trailers must be maintained in a level, horizontal position. For example, recreational vehicles such as travel trailers and the like should ideally be maintained in a level, horizontal position when parked in order to ensure comfort and proper operation of appliances, tables, and the like. Users of such vehicles generally prefer to sleep in a level position.

Generally, it is much easier to level such vehicles from front to back, than from side-to-side. In many cases, hydraulic and/or electric jacks can be used to accomplish the task of vehicle leveling. However, such jack mechanisms are frequently very expensive and difficult to install and operate. Additionally, unless they are attached to a vehicle when it is manufactured, major alterations are often required to install such devices on existing vehicles.

Simple leveling devices which are intended to fit under one or more wheels of a vehicle do exist. However, such leveling devices frequently exhibit a number of problems. Notably, difficulties exist in providing complete height adjustability, as well as a functional, non-slip surface onto which the wheels of a vehicle can solidly mount and rest.

In most instances, operators of recreational vehicles choose parking sites which are substantially level to begin with. As a result, only minor adjustments of a few inches are usually required to level a vehicle. Thus, it is generally desirable to have a leveling device which is quick and easy to use and, because space is often at a premium in recreational vehicles, such a leveling device should ideally require minimal space for storage.

Some existing devices provide ramp-type levelers for recreational vehicles, including multi-leveled or stackable devices. For example, U.S. Pat. No. 4,819,910 to Johnston describes a device for recreation vehicles comprising a pair of elongated rectangular interlocking ramp pieces, one to be stacked over the other. Lateral grooves on one piece receive lateral ridges on the other for interlocking. The pieces have, at their longitudinal ends, inclined, ramp-like edges to facilitate the driving of a wheel up onto one or both of the pieces. The height can be maintained at only two levels.

U.S. Pat. No. 4,427,179 to Price, discloses a leveling device made of planks of different length forming a ramp from only one side. Further, the planks which determine the height of the leveler do not possess any means for maintaining non-slip contact between the wheel and the leveler. U.S. Pat. No. 4,836,501 to Baer and U.S. Pat. No. 3,752,441 to Rogers disclose other multi-level devices which do not possess means for stabilizing or maintaining the wheel position on the leveler during wheel engagement.

While these devices may fulfill their respective and particular objectives and requirements, the need remains for a system that is superior to the leveling devices described above. The present invention is of durable construction and it's height is easily adjusted. The present invention also has an adjustable wheel chock feature, which will prevent a user from driving off the device and possibly damaging a recreational vehicle. The present invention is also very compact and light in weight, thereby allowing a user to easily store the present invention and, when desired, move the invention into a desired position.

SUMMARY OF THE INVENTION

The present invention is a device for side-to-side leveling of vehicles including, but not limited to, large recreational vehicles, travel trailers and the like parked on uneven surfaces. The present invention utilizes a support base having a substantially planar foundation which rests on an uneven surface upon which a vehicle is parked. Two upright parallel walls extending upward from said substantially planar foundation define a channel or recess in said support base. Said parallel walls are inclined; the walls are both lower at one end of said substantially planar foundation, and higher at the other end of said substantially planar foundation. A plurality of notches are cut into the upper surfaces of said parallel inclined walls in corresponding pairs. That is, the notches in the inclined upper surface of one wall are aligned with the notches in the inclined upper surface of the other wall. Because the parallel walls are inclined, corresponding pairs of notches are positioned at different heights in relation to the substantially planar foundation of the support base (and, thus, the uneven parking surface).

A generally elongate leveling track is pivotally disposed within the channel or recess formed by the upright parallel walls of the support base. In the preferred embodiment, a cylindrical rod is affixed to the bottom surface of said leveling track and is oriented perpendicular to the longitudinal axis of said leveling track. The ends of said cylindrical rod extend beyond the sides of said leveling track, and are pivotally received within a pair of aligned notches along the inclined upper surfaces of the upright parallel walls of the support base. Said leveling track can pivot or see-saw about a pivot axis which passes through and is aligned with said cylindrical rod.

An operator of a vehicle parked on an uneven surface must determine how much the low side of a vehicle must be raised in order for said vehicle to become level. This can often be done through simple visual observation. In some cases, a measuring instrument such as a sight-glass or other device can be used for this purpose.

Once the desired measurement has been obtained or otherwise determined, the vehicle is moved forward a short distance. The vehicle leveling device of the present invention is placed behind one wheel (or set of wheels) on the low side of said vehicle. After the vehicle leveling device of the present invention is set in place, the leveling track is adjusted to the appropriate location relative to support base. Specifically, the cylindrical rod of said leveling track is placed within a desired pair of notches of support base at a position which corresponds to the desired height adjustment. The leveling track of the present invention is tilted forward, so that the end of said leveling track nearest the vehicle wheels rests upon the uneven parking surface.

The vehicle to be leveled is then moved backward on to the present invention, so that the low-side wheel of said vehicle (or tandem wheels, as the case may be) ride up on to said leveling track. The operator continues to move the vehicle back on said leveling track. As the weight of the vehicle is transferred on to the leveling track, said leveling track pivots. The movement of the vehicle continues until the leveling track pivots into a substantially horizontal position. Thereafter, an adjustable chock is positioned against the wheel (or rear wheel of a set of tandem wheels) and secured in place. Said chock will thereafter provide a barrier to prevent said vehicle from rolling off the back end of said leveling track.

DETAILED DESCRIPTION OF THE PRESENT INVENTION

Figure 1:
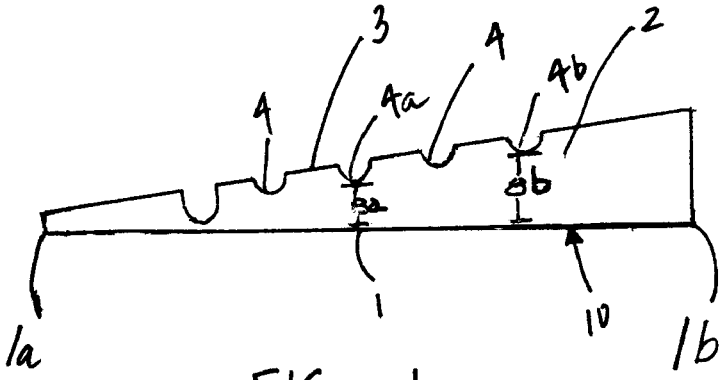
FIG. 1 depicts a side elevational view of a support base of the present invention.

Referring to the drawings, FIG. 1 depicts a side elevational view of support base 10 of the vehicle leveling apparatus of the present invention. Support base 10 is generally elongated in shape, having substantially planar foundation 1 and ends 1*a* and 1*b*. Upright side wall 2 extends along the length of foundation 1 from ends 1*a* to 1*b*. Upright side wall 2 is inclined, and the height of upright side wall 2 is greater at end 1*b* than at end 1*a*. Said upright side wall 2 defines inclined upper surface 3. Notches 4 are cut into upright side wall 2 along inclined upper surface 3. Although said notches 4 can exhibit any number of different shapes, in the preferred embodiment said notches 4 have a semi-circular or rounded shape. A second upright side wall, not shown on FIG. 1, runs parallel to said upright side wall 2. Because said notches are cut into said upright wall 2 at different locations along inclined super surface 3, said notches are positioned at different heights in relation to substantially planar foundation 1. For instance, distance 8*a* between notch 4 and substantially planar foundation 1 is less than distance 8*b* between notice 4*b* and substantially planar foundation 1.

Figure 2:
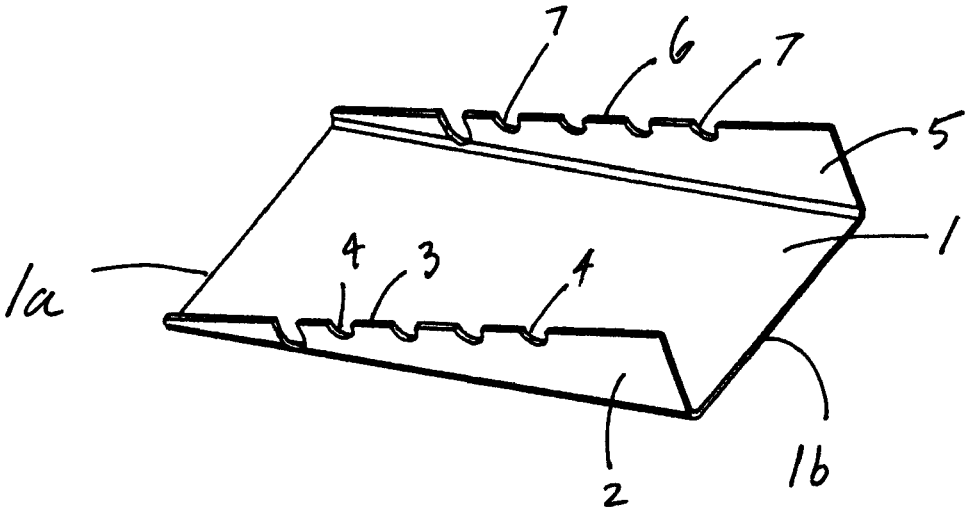
FIG. 2 depicts a top perspective view of a support base of the present invention.

FIG. 2 depicts a top perspective view of support base 10 of the present invention. Substantially planar foundation 1 forms a stable bottom for support base 10. Upright side wall 2 extends along the length of substantially planar foundation 1 from end 1*a* and 1*b*. Similarly, upright side wall 5, which is oriented parallel to upright side wall 2, also extends along the length of substantially planar foundation 1 from end 1*a* to end 1*b*. Both upright side wall 2 and upright side wall 5 extend higher near end 1*b* than end 1*a* of substantially planar foundation 1, thereby defining inclined upper surfaces 3 and 6. Notches 4 are cut into upright side wall 2 along inclined upper surface 3. Similarly, notches 7 are cut into upright side wall 5 along inclined upper surface 6. In the preferred embodiment, notches 4 and 7 exhibit a semi-circular or rounded shape, and are aligned across from one another.

Figure 3:
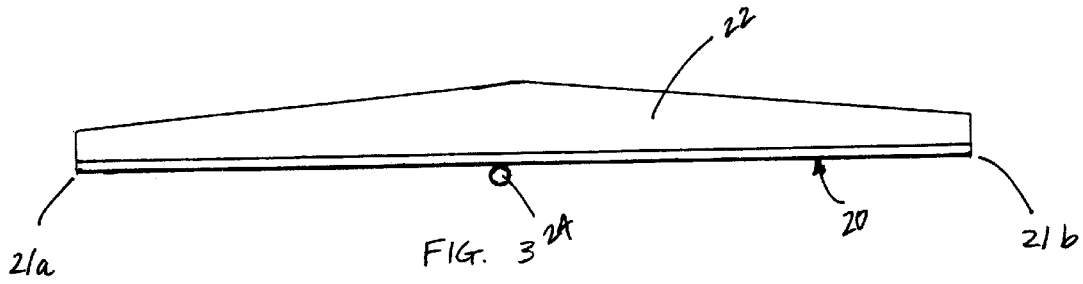
FIG. 3 depicts a side elevational view of a leveling track of the present invention.

FIG. 3 depicts a side elevational view of leveling track 20 of the present invention. Leveling track 20 includes substantially planar base 21 which extends from end 21*a* to 21*b*. Upright side wall 22 extends along one side of leveling track 20 from end 21*a* to end 21*b*. Although not depicted in FIG. 3, a second such upright wall, upright side wall 23, runs parallel to upright side wall 22 along the opposite side of leveling track 20. Side walls 22 and 23 can have any number of different shapes. However, in the preferred embodiment, side walls 22 and 23 are substantially the same height near ends 21*a* and 21*b*; said side walls 22 and 23 reach their apex near the center of said side walls 22 and 23. Cylindrical rod 24 is affixed to the bottom surface of substantially planar base 21, and is oriented perpendicular to the longitudinal axis of leveling track 20.

Figure 4:
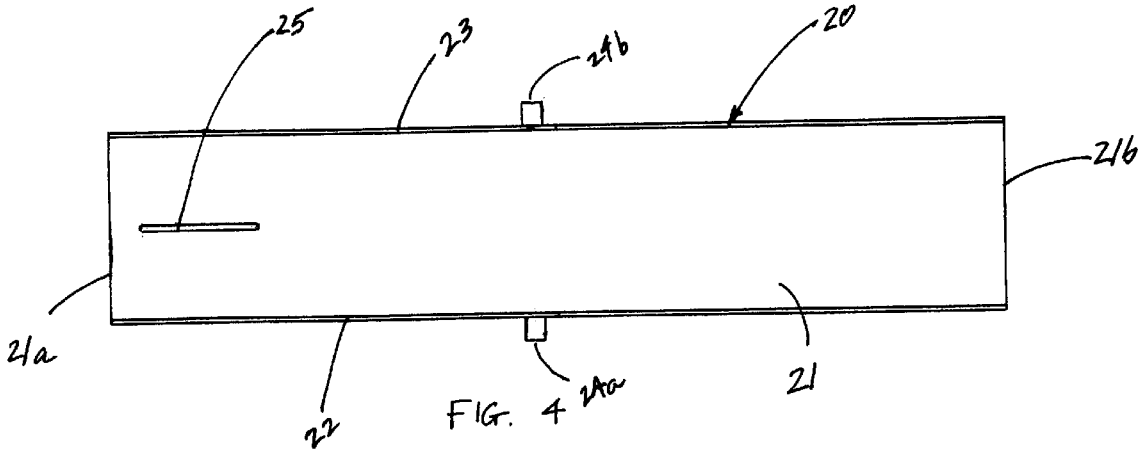
FIG. 4 depicts a top view of a leveling track of the present invention.

FIG. 4 depicts a top view of leveling track 20 of the present invention. Substantially planar base 21 extends from end 21*a* to 21*b*. Upright side walls 22 and 23 run parallel to one another along two opposite sides of said substantially planar base 21. Cylindrical rod 24 is affixed to the bottom surface of substantially planar base 21, and is oriented perpendicular to the longitudinal axis of leveling track 20. Cylindrical rod 24 is of greater length than the width of substantially planar base 21. As a result, ends 24*a* and 24*b* of cylindrical rod 24 extend beyond the side edges of substantially planar base 21 and upright side walls 22 and 23. In the preferred embodiment, elongated slot 25 is situated near one end (in this case end 21*a*) of substantially planar base 21 and extends through said substantially planar base 21.

Figure 5:
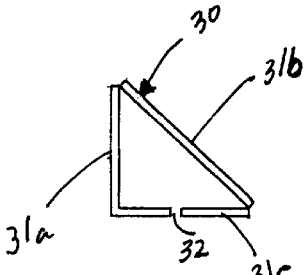
FIG. 5 depicts an elevational view of an adjustable chock of the present invention.
Figure 6:
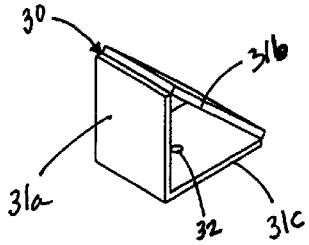
FIG. 6 depicts a top perspective view of an adjustable chock of the present invention.

FIG. 5 depicts a side cross sectional cut away view of adjustable chock 30 of the present invention. In the preferred embodiment, adjustable chock 30 has three (3) sides. Side 31*a*, side 31*b* and base 31*c* of adjustable chock 30 form a right triangle. Bore 32 extends through base 31*c*. FIG. 6 depicts a perspective view of adjustable chock 30. Sides 31*a* and 31*b*, together with base 31*c*, form a right triangle. Bore 32 extends through base 31*c*.

Figure 7:
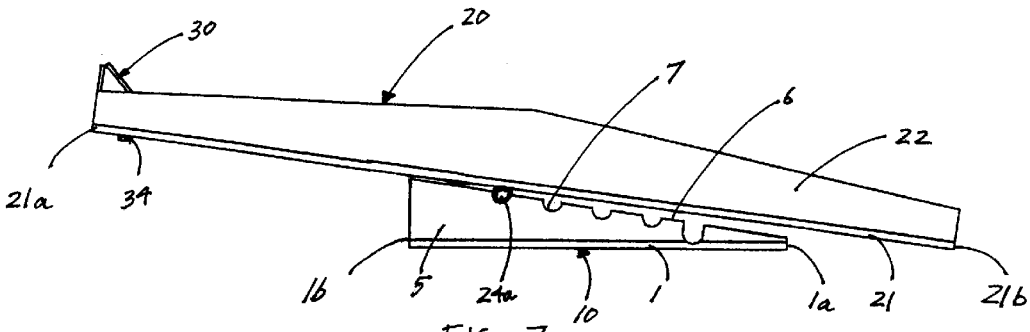
FIG. 7 depicts a side elevational view of an assembled vehicle leveling apparatus of the present invention wherein the leveling track is in the down position.

FIG. 7 depicts a side elevational view of the vehicle leveling apparatus of the present invention, wherein leveling track 20 is shown in the "down" position. Leveling track 20 is disposed within the recess formed between upright side wall 2 and upright side wall 5 of support base 10. Cylindrical rod 24 is pivotally received within semicircular notch 7 in inclined upper surface 6 of upright side wall 5. Because said cylindrical rod 24 is free to rotate within notch 7, leveling track 20 can pivot about a pivot axis which passes through cylindrical rod 24. In FIG. 7, end 21*b* of substantially planar base 21 is depicted in a "down" or tilted position. In this position, end 21*b* of substantially planar base 21 would rest against the ground or other foundation which supports the present invention, and leveling track 20 would thereby provide a ramp-like structure. Chock 30 is affixed to leveling track 20 near end 21*a* of substantially planar base 21.

Figure 8:
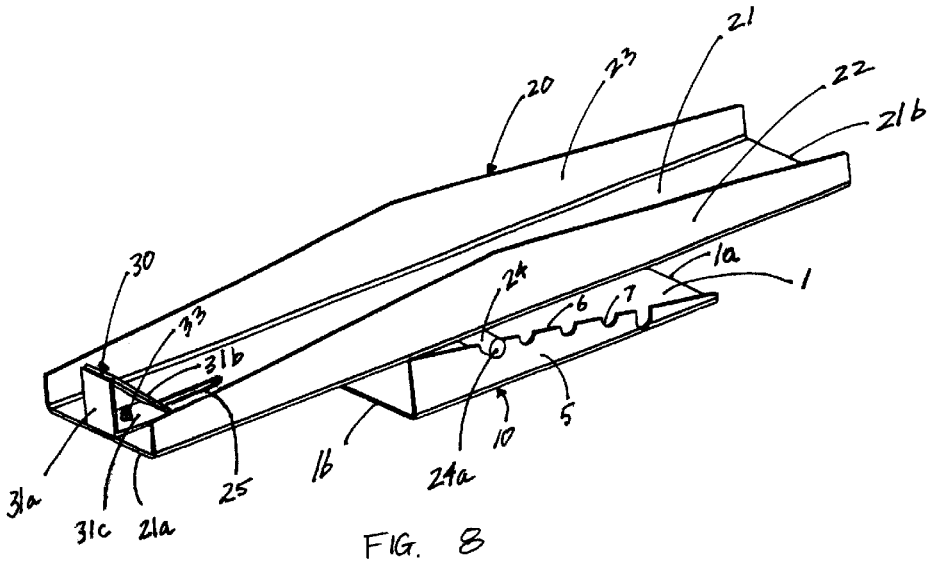
FIG. 8 depicts a side perspective view of an assembled vehicle leveling apparatus of the present invention in the up position.

FIG. 8 depicts a side perspective view of an assembled vehicle leveling apparatus of the present invention. Generally, substantially planar foundation 1 forms the bottom of support base 10. Upright side wall 5 extends along the length of substantially planar foundation 1 from end 1*a* and 1*b*. Upright side wall 5 extends higher near end 1*b* than end 1*a*, thereby defining inclined upper surface 6 of upright side wall 5. Notches 7 are cut into upright side wall 5 along inclined upper surface 6. In the preferred embodiment, notches 7 exhibit a semi-circular or rounded shape.

Leveling track 20 is disposed within the recess formed between upright side wall 5 and upright side wall 2 (not depicted in FIG. 8) of support base 10. Substantially planar base 21 of leveling track 20 extends from end 21*a* to 21*b*.

Upright side walls 22 and 23 run parallel to one another along the opposing sides of substantially planar base 21. Cylindrical rod 24 is affixed to the bottom surface of substantially planar base 21, and is oriented perpendicular to the longitudinal axis of leveling track 20. The length of cylindrical rod 24 is greater than the width of substantially planar base 21. As a result, end 24*a* of cylindrical rod 24 extends beyond the edge of substantially planar base 21 and is received within notch 7 in inclined upper surface 6 of upright side wall 5 of support base 10.

Figure 9:
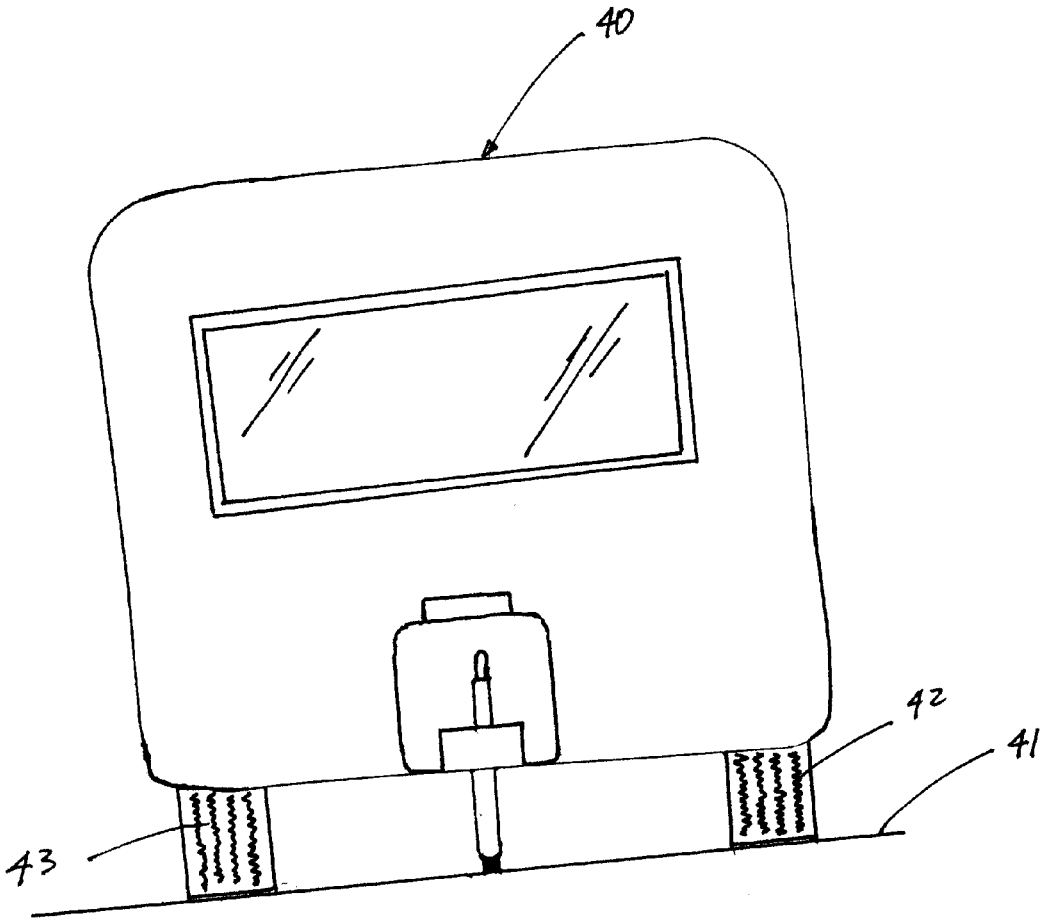
FIG. 9 depicts a front elevational view of a vehicle parked on an uneven surface.

FIG. 9 depicts an elevational view of the front of a recreational vehicle parked on a terrain which is not level. Recreational vehicle 40 is parked on uneven surface 41, causing tandem wheels 42 to be situated higher than tandem wheels 43. As a result, recreational vehicle 40 leans laterally, that is from side to side.

Figure 10:
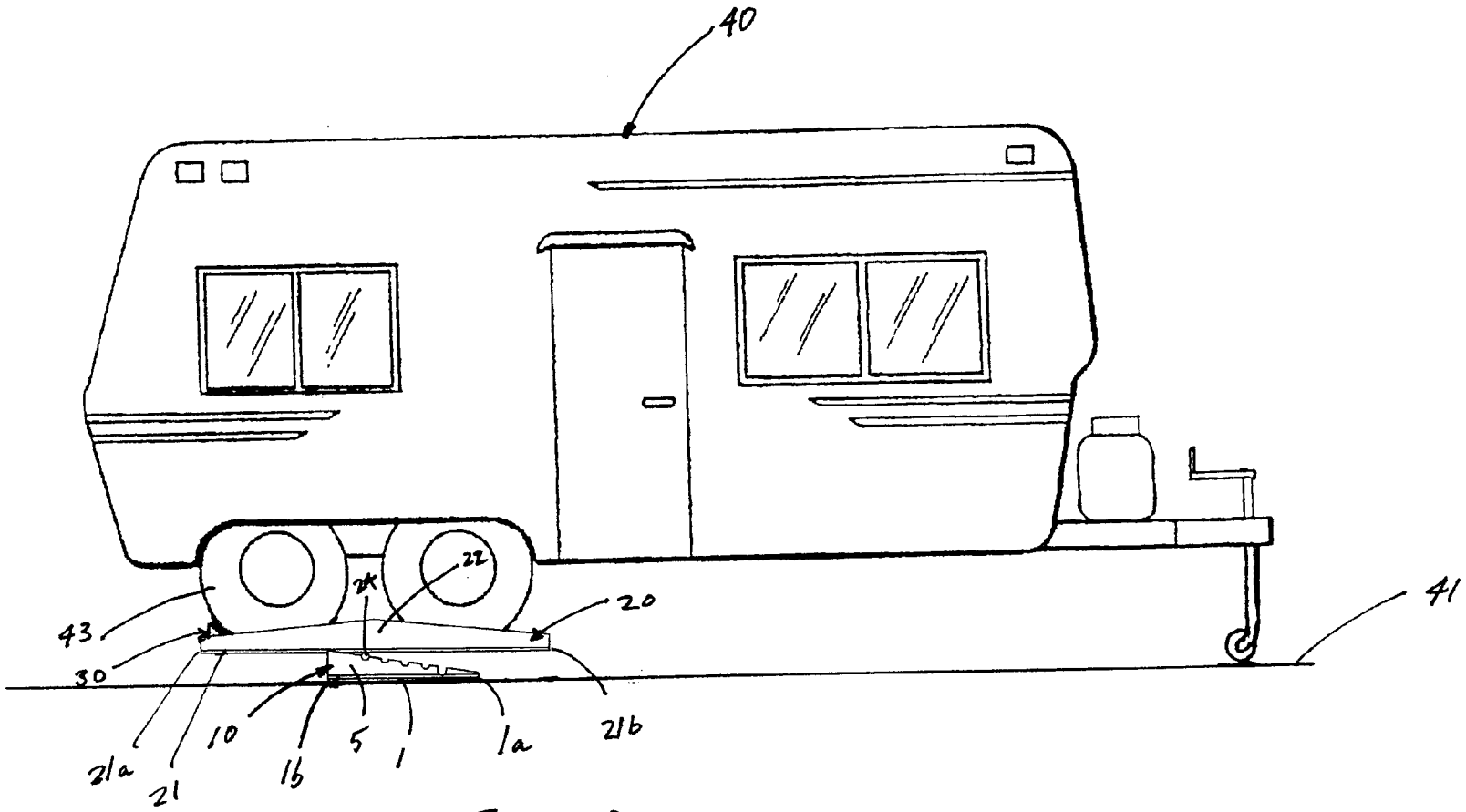
FIG. 10 depicts a side elevational view of a vehicle with one set of tandem wheels supported by the vehicle leveling apparatus of the present invention.

FIG. 10 depicts a side elevational view of recreational vehicle 40 with one set of tandem wheels 43 supported by the vehicle leveling apparatus of the present invention. Referring to FIG. 10, recreational vehicle 40 is parked on uneven surface 41. Substantially planar foundation 1, which forms the bottom of support base 10, is positioned on uneven surface 41. Upright side wall 5 extends along the length of substantially planar foundation 1 from end 1*a* and 1*b*. Upright side wall 5 extends higher near end 1*b* than end 1*a*, thereby defining inclined upper surface 6 of upright side wall 5. Notches 7 are cut into upright side wall 5 along inclined upper surface 6.

Leveling track 20 is disposed within the recess formed between upright side wall 5 and upright side wall 2 (not depicted in FIG. 8) of support base 10. Substantially planar base 21 of leveling track 20 extends from end 21*a* to 21*b*. Upright side walls 22 run along the sides of substantially planar base 21 of leveling track 20. Cylindrical rod 24 is affixed to the bottom surface of substantially planar base 21 of leveling track 20, and is oriented perpendicular to the longitudinal axis of leveling track 20. The length of 10 cylindrical rod 24 is greater than the width of substantially planar base 21. As a result, end 24*a* of cylindrical rod 24 extends beyond the edge of substantially planar base 21 and is received within notch 7 in inclined upper surface 6 of upright side wall 5 of support base 10.

In operation, the vehicle leveling device of the present invention is very simple to use. First, the operator of a vehicle parked on an uneven surface must determine how much the low side of said vehicle must be raised in order for said vehicle to become level. This can often be done through simple visual observation. In some cases, a measuring instrument such as a sight-glass can be used for this purpose.

Once this measurement has been obtained or otherwise determined, the vehicle is moved forward a short distance. Although this step is generally not required in all situations, it is frequently desirable for accurate vehicle leveling, since a different height measurement might be required at another location along an uneven parking surface. Thereafter, the vehicle leveling device of the present invention is placed behind one wheel (or set of wheels) on the low side of said vehicle. After the vehicle leveling device of the present invention is set in place, leveling track 20 is adjusted to the appropriate location relative to support base 10. Specifically, cylindrical rod is placed within notches 4 and 7 of support base 10 at a position which corresponds to the desired height adjustment. The leveling track of the present invention is tilted forward, so that the end of said leveling track nearest the vehicle wheels, end 21*a*, rests upon the uneven parking surface.

Next, the vehicle is moved backward, so that the low-side wheel of said vehicle (or tandem wheels, as the case may be) ride up on to said leveling track. The operator continues to move backward on said leveling track. As the weight of the vehicle is transferred on to the leveling track, said leveling track pivots about the cylindrical rod within notches 4 and 7, thereby causing end 21*b* of leveling track 20 to rise upward. Such backward movement of the vehicle continues until leveling track 20 is substantially horizontal. Thereafter adjustable chock 30 is moved within slot 25 against wheel 43 on leveling track 20 and secured in place. Adjustable chock 30 will thereafter provide a barrier to prevent said vehicle from rolling off end 21*a* of leveling track 20.

What is claimed:

1. An apparatus for leveling a vehicle comprising:

a. a base member having a channel, wherein said channel has a first end and a second end, and said first end of said channel is higher than said second end of said channel;

b. a substantially planar member pivotally disposed within said channel, wherein said substantially planar member pivots about a pivot axis which is perpendicular to the longitudinal axis of said channel; and c. means for adjusting the location of said pivot axis between the first and second ends of said channel.

2. The apparatus of claim 1, wherein said channel is formed by a pair of inclined walls oriented parallel to one another.

3. The apparatus of claim 2, wherein said means for adjusting the location of said pivot axis between the first and second ends of said channel further comprises:

a. a plurality of notches in the upper surface of said inclined walls; and b. a rod affixed to said substantially planar member, wherein said rod is oriented perpendicular to the longitudinal axis of said substantially planar member, and received within at least two of said notches.

4. An apparatus for leveling a vehicle comprising:

a. a base member comprising:

i. a substantially planar member; and ii. first and second walls extending upward from said substantially planar member, wherein said first and second walls are oriented parallel to one another and inclined at a common angle;

b. a track member disposed between said first and second walls of said base member, wherein said track member pivots about a pivot axis which is perpendicular to the longitudinal axes of said first and second walls; and c. means for adjusting the location of said pivot axis along the length of said first and second walls.

5. The apparatus of claim 4, wherein said means for adjusting the location of said pivot axis along the length of said first and second walls further comprises:

a. a plurality of notches in the upper surfaces of said first and second walls, wherein the notches on said first wall are aligned with the notches on said second wall; and b. a rod affixed to said track member, wherein said rod is oriented perpendicular to the longitudinal axes of said first and second walls, and pivotally received within one notch on said first wall and an aligned notch on said second wall.

6. The apparatus of claim 4, wherein said track member further comprises:

a. an elongate and substantially planar foundation having a front, a back and two sides; and b. upright walls along said two sides, wherein said walls are parallel to the longitudinal axis of said elongate and substantially planar foundation.

7. The apparatus of claim 6, further comprising traction promoting elements disposed on the upper surface of said elongate and substantially planar foundation.

8. The apparatus of claim 6, further comprising a chock affixed to the upper surface of said elongate and substantially planar foundation.

9. The apparatus of claim 8, further comprising means for adjusting the location of said chock between the front and back of said elongate and substantially planar foundation.

10. The apparatus of claim 9, wherein said means for adjusting the location of said chock between the front and back of said elongate and substantially planar foundation further comprises:

a. a slot extending through said elongate and substantially planar foundation, wherein said slot is oriented parallel to the longitudinal axis of said elongate and substantially planar foundation;

b. a bolt affixed to said chock, wherein said bolt is slidably disposed within said slot; and c. a nut threaded on said bolt.

* * * * *